US007290552B1

(12) United States Patent
Eisbrenner

(10) Patent No.: US 7,290,552 B1
(45) Date of Patent: Nov. 6, 2007

(54) PORTABLE AWNING

(76) Inventor: Arno Eisbrenner, 11304 Mohawk Rd., Apple Valley, CA (US) 92308

( * ) Notice: Subject to any disclaimer, the term of this patent is extended or adjusted under 35 U.S.C. 154(b) by 162 days.

(21) Appl. No.: 10/992,550

(22) Filed: Nov. 18, 2004

Related U.S. Application Data

(60) Provisional application No. 60/523,151, filed on Nov. 18, 2003.

(51) Int. Cl.
*E04H 15/04* (2006.01)

(52) U.S. Cl. ..... 135/90; 135/117; 135/119; 182/187

(58) Field of Classification Search ..... 135/117–119, 135/901, 902, 155, 121, 90, 905, 120.3; 43/1; 160/22, 46, 66–67; 182/142, 187, 136
See application file for complete search history.

(56) References Cited

U.S. PATENT DOCUMENTS 2,928,405 A * 3/1960 Lawson ..... 135/95
4,505,286 A * 3/1985 Madion ..... 135/90
4,705,143 A * 11/1987 Ziemba ..... 182/187
4,739,785 A * 4/1988 Poulson ..... 135/117
4,836,232 A * 6/1989 De Rosa et al. ..... 135/99
5,088,514 A * 2/1992 House et al. ..... 135/139
5,316,105 A * 5/1994 Reggin et al. ..... 182/187
5,400,813 A * 3/1995 Swan, Jr. ..... 135/119
5,446,580 A * 8/1995 Collins ..... 359/350
6,014,837 A * 1/2000 Morgan ..... 47/31
6,050,280 A * 4/2000 Jeske ..... 135/117
6,202,659 B1 * 3/2001 Sachs ..... 135/20.1
6,243,979 B1 * 6/2001 Seats et al. ..... 182/135
6,796,359 B1 * 9/2004 Knutson ..... 160/156
7,137,398 B2 * 11/2006 George ..... 135/90

* cited by examiner

*Primary Examiner*—Winnie Yip
(74) *Attorney, Agent, or Firm*—Goldstein Law Office P.C.

(57) ABSTRACT

A portable awning comprising a flexible shading element, an attachment strap for anchoring the shading element to an existing vertical support structure, and poles for maintaining the shading element at a vertically elevated position with respect to the surface of the ground. The shading element is constructed from a waterproof material such as canvas or nylon and substantially protects a user from overexposure to inclement environmental conditions, including direct sunlight, wind, rain, and snow. The poles and the attachment strap are easily disengaged from the shading element, and the shading element is foldable, thereby providing a portable awning which is easily disassembled in order that it be transported between locations or stored between successive uses.

3 Claims, 3 Drawing Sheets

PORTABLE AWNING

CROSS REFERENCES AND RELATED SUBJECT MATTER

This application is a continuation of provisional patent application Ser. No. 60/523,151 filed in the United States Patent Office on Nov. 18, 2003.

BACKGROUND OF THE INVENTION

1. Field of the Invention

The invention generally relates to an awning, and in particular relates to a portable awning having a shading element, an attachment strap for anchoring the shading element to an existing vertical support structure, and poles for rigidly maintaining the shading element at a vertically elevated position above the ground.

2. Description of the Related Art

Many millions of individuals engage in various outdoor recreational activities, including camping, picnicking, or merely reclining outdoors in a lounge chair. Although such outdoor activities generally afford a great deal of satisfaction and pleasure to an individual, there are notable drawbacks associated with such activities. In particular, inclement environmental conditions, including direct sunlight, rain, and wind, may make it difficult for the individual to comfortably remain outdoors for a prolonged period of time. Accordingly, there is a need for a portable awning which is easily and selectively mounted to a variety of existing support structures, and which provides protection from inclement environmental conditions, thereby making it possible for the individual to comfortably remain outdoors for a prolonged period of time.

A variety of portable awnings have been devised. For example, U.S. Pat. No. 6,050,280 to Jeske appears to show a portable awning which is selectively wound around a roller tube, having telescoping legs and guy lines for lateral stability. Additionally, U.S. Pat. No. 1,618,065 to Davis appears to show a portable awning which is foldable, having embedded tubular elements for support. Moreover, U.S. Pat. No. 5,558,145 to Baka appears to show a portable awning comprising a roller tube supported by a pair of adjustable support poles, and a header bar having suction cups for selective attachment to a roof of an existing vehicle.

While these devices may be suitable for the particular purpose employed, or for general use, they would not be as suitable for the purposes of the present invention as disclosed hereafter.

SUMMARY OF THE INVENTION

It is an object of the invention to provide a portable awning capable of substantially protecting a user from overexposure to inclement environmental conditions, including direct sunlight, wind, rain, and snow. Accordingly, the portable awning has a broad shading element constructed from a waterproof material such as canvas or nylon which substantially protects the user from overexposure to inclement environmental conditions, including direct sunlight, wind, rain, and snow.

It is another object of the invention to provide a portable awning which may be easily and selectively attached to a vertical support structure such as a tree trunk. Accordingly, two adjacent corners of the substantially rectangular shading element have holes extending fully therethrough. The portable awning has a flexible attachment strap having two ends, each having a curved hook attached thereunto. The attachment strap is wrapped around the vertical support structure, and the hooks at the ends of the attachment strap selectively engage the holes positioned at adjacent corners of the shading element, thereby providing a portable awning which is easily and selectively attachable to a vertical support structure such as a tree trunk.

It is yet another object of the invention to provide a portable awning having a shading element which may be easily maintained at an elevated position above the surface of the ground. Accordingly, the shading element has two long poles selectively attached thereunto, for maintaining the shading element at an elevated position above the surface of the ground.

It is an additional object of the invention to provide a portable awning which is easily transported between locations. Accordingly, the poles and the attachment strap are easily disengaged from the shading element, and the flexible shading element is foldable, thereby providing a portable awning which is easily disassembled in order that it be easily transported between locations.

It is another object of the invention to provide a portable awning which is affordable. Accordingly, the materials from which the portable awning is constructed are readily available and its cost is not prohibitive.

Further objects of the invention will become apparent in the detailed description of the invention which follows.

The invention is a portable awning comprising a flexible shading element, an attachment strap for anchoring the shading element to an existing vertical support structure, and poles for maintaining the shading element at a vertically elevated position with respect to the surface of the ground. The shading element is constructed from a waterproof material such as canvas or nylon and substantially protects a user from overexposure to inclement environmental conditions, including direct sunlight, wind, rain, and snow. The poles and the attachment strap are easily disengaged from the shading element, and the shading element is foldable, thereby providing a portable awning which is easily disassembled in order that it be transported between locations or stored between successive uses.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
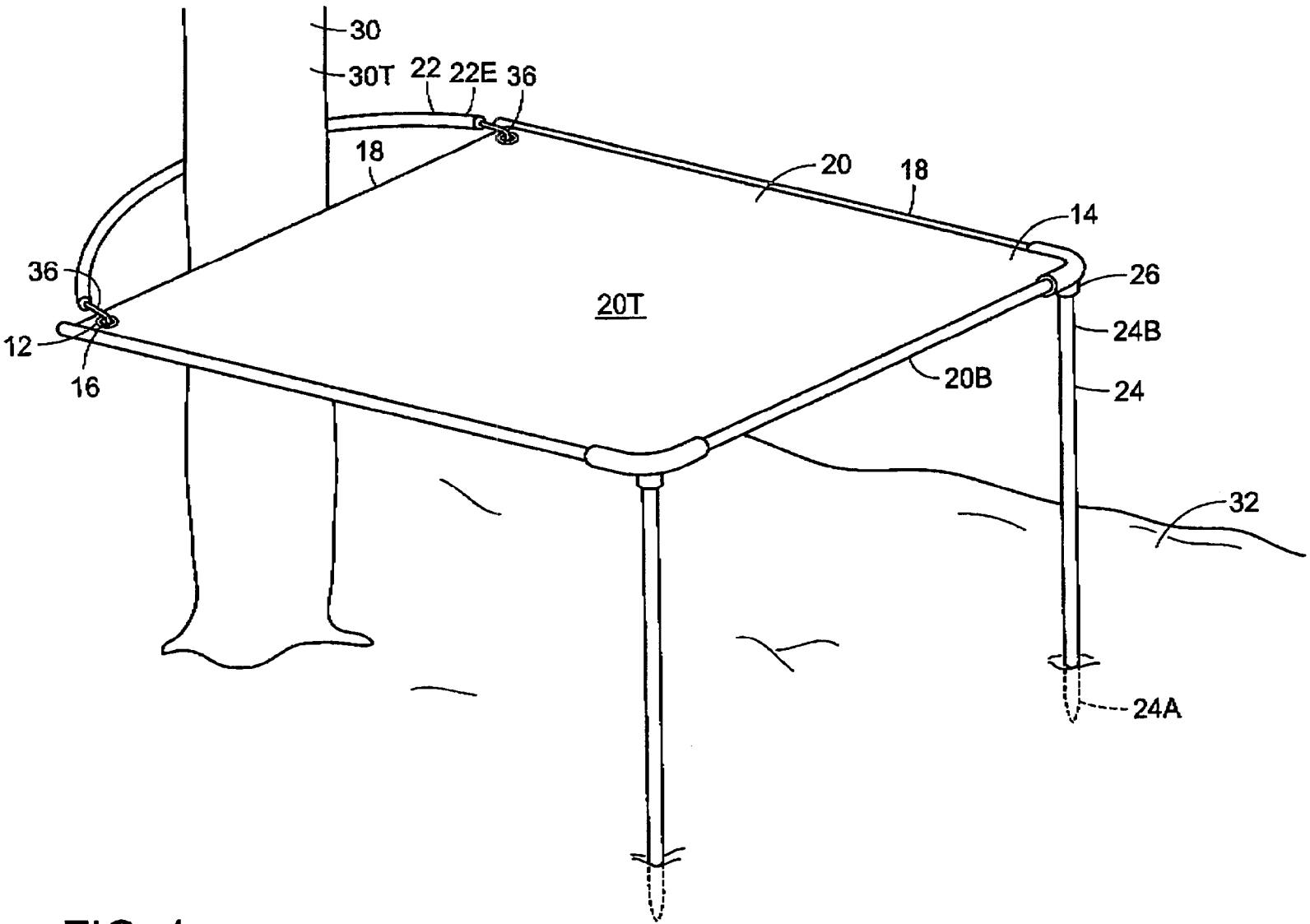
FIG. 1 is a perspective view of a portable awning after an attachment strap has been anchored around a trunk of a tree and to a shading element, and after two long poles extending from the shading element have been driven into the ground.

FIG. 1 illustrates a portable awning 10 being used in conjunction with an existing tree 30 having a trunk 30T which extends vertically upward from the ground 32. The portable awning 10 comprises a shading element 20, an attachment strap 22 for selectively anchoring the shading element 20 to a vertical support structure such as the trunk 30T of a tree 30, two pole anchors 26 attached to the shading element 20, and two hollow long poles 24 which selectively extend from the two pole anchors 26 and into the ground 32, in order to maintain the shading element 20 at a vertically elevated position with respect to the ground 32.

The shading element 20 comprises a substantially rectangular flexible sheet constructed from a waterproof material 26 such as canvas or nylon, and has a top surface 20T and a bottom surface 20B. The top surface 20T is visible in FIG. 1. The shading element 20 has four corners 14 and four sides 18. The shading element 20 has two holes 16, each located in proximity to a different one of two adjacent corners 14. The two holes 16 extend fully from the top surface 20T to the bottom surface 20B. The holes 16 each have a grommet 12 which provides stability to the hole 16 and keep the hole 16 from ripping.

The attachment strap 22 is constructed from a flexible cord-like material, and has two ends 22E, each having a curved hook 36 attached thereunto, said hooks 36 for selectively engaging the holes 16 extending through the shading element 20.

The two pole anchors 26 are attached in proximity to two adjacent corners 14 of a side 18 of the shading element 20 which is opposed to the side 18 of the shading element 20 having the holes 16. Each of the substantially cylindrical long poles 24 has a pointed first end 24A and a second end 24B. In order to elevate the shading element 20 above the ground 32, the second end 24B of each long pole 24 is selectively attached to a different one of the pole anchors 26, and the pointed first end 24A is selectively driven into the ground 32.

It is contemplated that the portable awning 10 will be additionally provided with a set of two shorter poles, which may be used instead of the two long poles 24 for selectively anchoring the portable awning 10 to the ground. Use of the shorter poles allows the side 18 of the shading element 20 from which the pole anchors 26 extend to be positioned closer to the ground 32.

Figure 2:
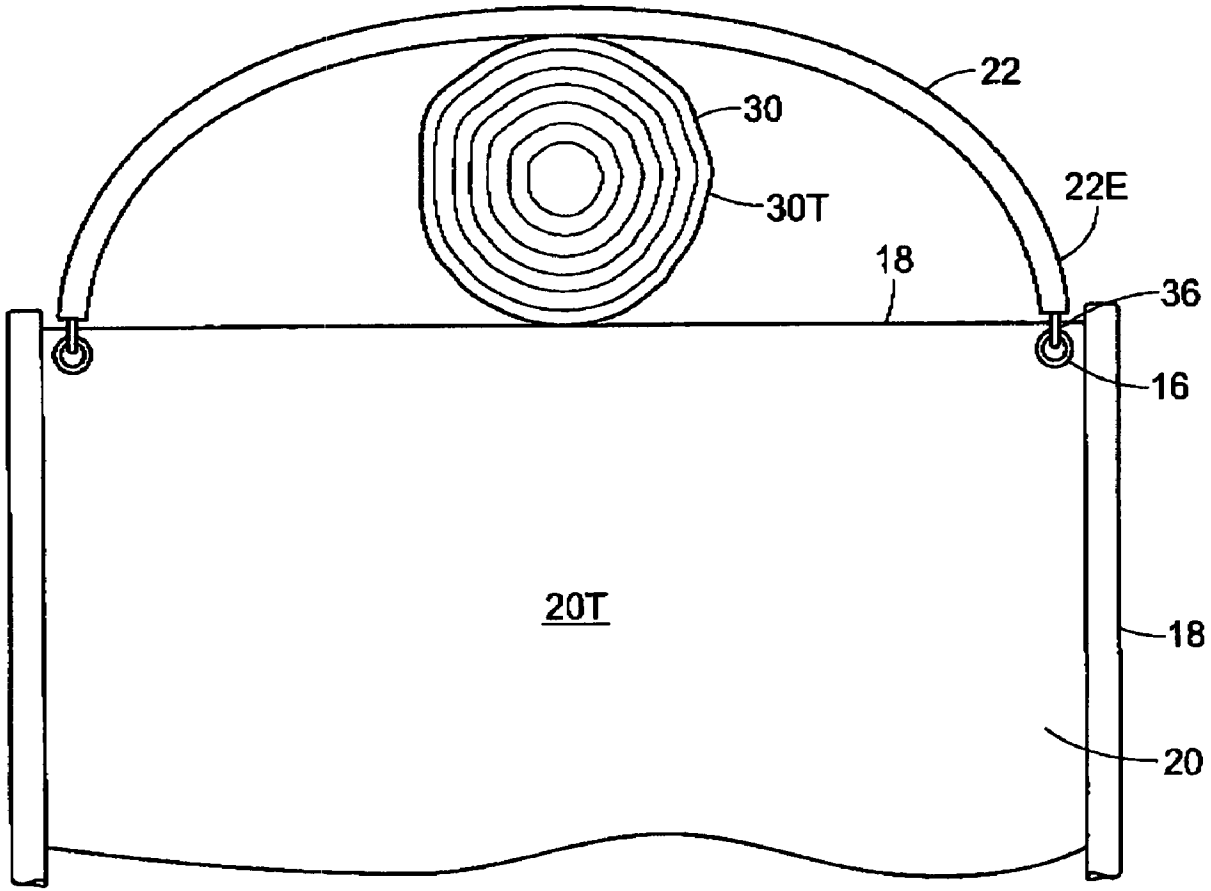
FIG. 2 illustrates a top elevational view of the portable awning after the attachment strap has been anchored around the trunk of the tree and to the shading element, wherein the trunk of the tree is shown in cross-section.

FIG. 2 illustrates a top elevational view of the portable awning 10 after selective attachment to the trunk 30T of the tree 30, wherein the trunk 30T is shown in cross-section. The attachment strap 22 selectively attaches the shading element 20 to the trunk 30T.

Figure 3:
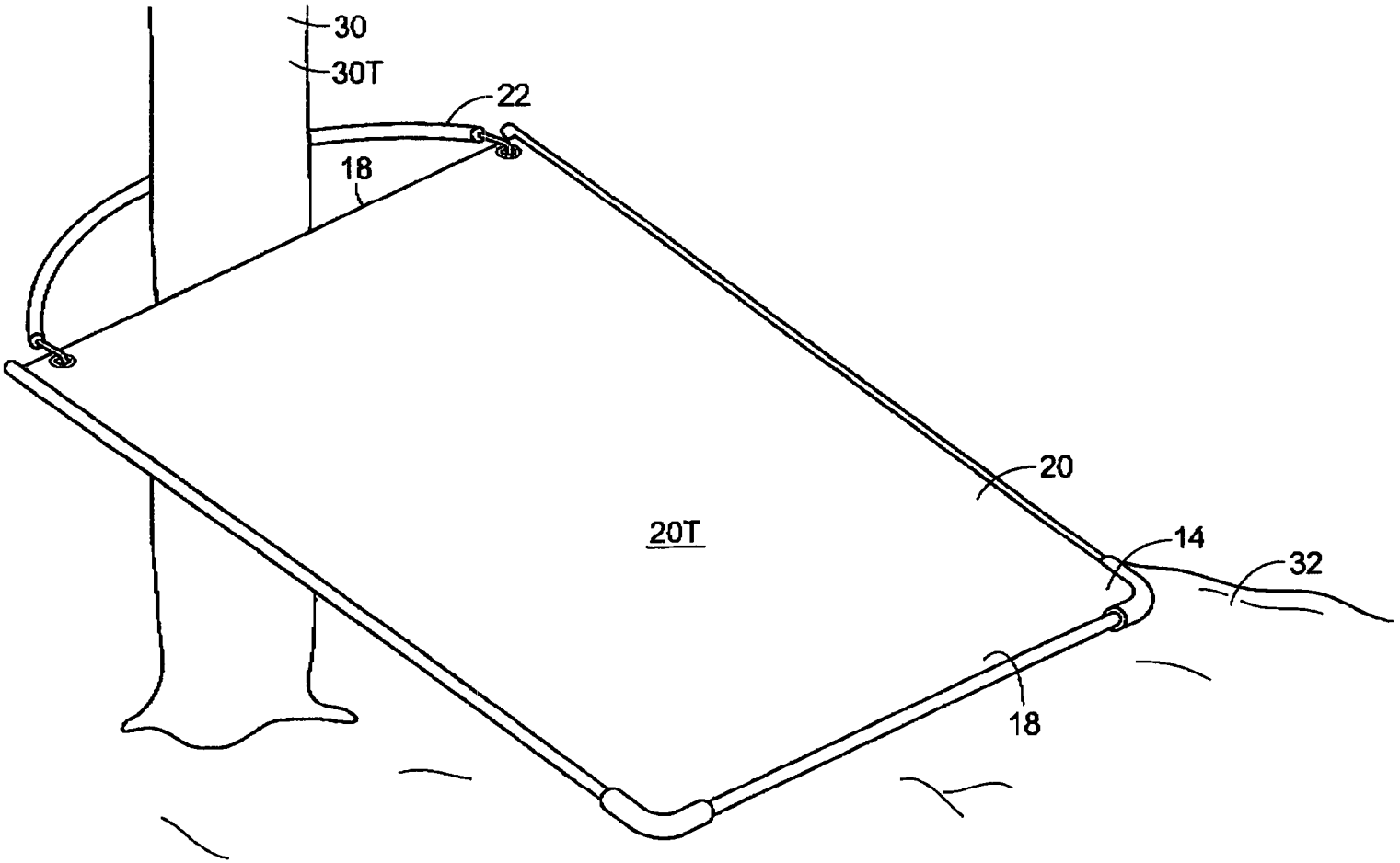
FIG. 3 illustrates a perspective view of the portable awning after the attachment strap has been anchored around the trunk of the tree and to the shading element, wherein the long poles have been detached from the shading element, in order to allow one side of the shading element to rest directly on the ground.

FIG. 3 illustrates a view of the portable awning 10 after selective attachment to a trunk 30T of a tree 30, wherein the poles 24 have not been attached to the pole anchors 26 as in FIG. 1. Rather, one side 18 of the shading element 20 rests directly on the ground 32. Accordingly, the shading element 20 is not horizontally situated with respect to the ground 32, as it is in FIG. 1, but forms an acute angle with respect to the ground 32. The attachment strap 22 has been anchored around the trunk 30T of the tree 30, in order to maintain the side 18 opposed to the side 18 which rests on the ground 32 at an elevated position with respect to the ground 32.

In use, a user stores the portable awning 10 along with other accessories typically used in conjunction with outdoor activities in between successive uses. When an outdoor activity is planned, the user ensures that the portable awning 10 is one of the accessories that are brought along. When needed for shelter, the portable awning 10 is selectively mounted to an existing vertical support structure such as a trunk 30T of a tree 30, a frame of an existing motor vehicle, or a portion of an existing fence, by engaging said support structure with the attachment strap 22 and by engaging the holes 16 of the shading element 20 with the hooks 36 at the ends 22E of the attachment strap 22. If the user desires to maintain the shading element 20 substantially parallel to the ground 32, the user inserts the second end 24B of the long poles 24 into the pole anchors 26 and presses the sharp first end 24A into the ground 32. The shading element 20 protects the user from excessive exposure to inclement environmental conditions such as direct sunlight, rain, snow, and/or wind. After it has been used, the hooks 36 of the attachment strap 22 are disengaged from the holes 16, the poles 24 are removed from the ground 32 and detached from the pole anchors 26, and the shading element 20 is folded. The portable awning 10 may now be compactly stored until once again needed.

In conclusion, herein is presented a portable awning for selective attachment to a horizontal and vertical support structure, for providing shelter from inclement environmental conditions. The invention is illustrated by example in the drawing figures, and throughout the written description. It should be understood that numerous variations are possible, while adhering to the inventive concept. Such variations are contemplated as being a part of the present invention.

What is claimed is:

1. A portable awning, for providing shelter upon attachment to a vertical support structure extending upwardly from a ground surface, comprising:

a flexible shading element, including a substantially rectangular flexible sheet constructed from a waterproof material having a top surface, a bottom surface, four sides and four corners, the flexible shading element having a pair of holes located at two adjacent corners and two pole anchors located at two adjacent corners where the holes are not located;

an attachment strap, for extending around the vertical support structure, the attachment strap constructed of a flexible cord-like material and having two ends, each end having a hook attached thereon for securing in the holes of the shading element; and a pair of long poles, for selectively mating with the pole anchors in the flexible shading element, engaging the ground surface, and supporting the shading element therefrom.

2. The portable awning as recited in claim 1, wherein each of the long poles have a pointed first end and a second end, such that the second end of each long pole is selectively attached to one of the pole anchors and the pointed first end thereof is selectively driven into the ground surface.

3. The portable awning as recited in claim 2, wherein each of the holes have a grommet for providing stability to the hole and preventing the hole from ripping when one of the hooks is inserted therein.

* * * * *